US008931773B2

(12) United States Patent
Sugiyama et al.

(10) Patent No.: US 8,931,773 B2
(45) Date of Patent: Jan. 13, 2015

(54) SHEET FOLDING DEVICE HAVING INCLINED STACKING SURFACE

(71) Applicants: Keisuke Sugiyama, Tokyo (JP); Masahiro Tamura, Kanagawa (JP); Shuuya Nagasako, Kanagawa (JP); Tomohiro Furuhashi, Kanagawa (JP); Yuusuke Shibasaki, Kanagawa (JP); Kazuya Yamamoto, Kanagawa (JP); Kyosuke Nakada, Kanagawa (JP); Tomomichi Hoshino, Kanagawa (JP); Yasuo Niikura, Miyagi (JP); Junya Suzuki, Miyagi (JP); Kazunori Konno, Miyagi (JP); Akira Kunieda, Tokyo (JP); Takahiro Watanabe, Kanagawa (JP); Tomohiro Yoshizaki, Saitama (JP); Kiichiro Goto, Kanagawa (JP)

(72) Inventors: Keisuke Sugiyama, Tokyo (JP); Masahiro Tamura, Kanagawa (JP); Shuuya Nagasako, Kanagawa (JP); Tomohiro Furuhashi, Kanagawa (JP); Yuusuke Shibasaki, Kanagawa (JP); Kazuya Yamamoto, Kanagawa (JP); Kyosuke Nakada, Kanagawa (JP); Tomomichi Hoshino, Kanagawa (JP); Yasuo Niikura, Miyagi (JP); Junya Suzuki, Miyagi (JP); Kazunori Konno, Miyagi (JP); Akira Kunieda, Tokyo (JP); Takahiro Watanabe, Kanagawa (JP); Tomohiro Yoshizaki, Saitama (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/688,758

(22) Filed: Nov. 29, 2012

(65) Prior Publication Data

US 2013/0147105 A1 Jun. 13, 2013

(30) Foreign Application Priority Data

Dec. 9, 2011 (JP) ..... 2011-270127

(51) Int. Cl.
*B65H 37/06* (2006.01)
*B65H 39/00* (2006.01)

(Continued)

(52) U.S. Cl.
CPC ..... *B65H 39/00* (2013.01); *B65H 29/18* (2013.01);

(Continued)

(58) Field of Classification Search
CPC ..... B65H 37/06
USPC ..... 270/32, 37, 39.06, 39.07, 39.08, 45; 493/444, 445; 271/198
See application file for complete search history.

(56) References Cited

U.S. PATENT DOCUMENTS 5,178,379 A * 1/1993 Edwards et al. ..... 271/189
5,207,412 A * 5/1993 Coons et al. ..... 270/1.02

(Continued)

FOREIGN PATENT DOCUMENTS

JP 2006-143466 6/2006
JP 4179011 9/2008
JP 2010-143677 7/2010

*Primary Examiner* — Patrick Mackey
(74) *Attorney, Agent, or Firm* — Harness, Dickey & Pierce P.L.C.

(57) ABSTRACT

A sheet handling apparatus includes a sheet folding unit configured to perform folding on a sheet; and a sheet stacking unit configured to stack the folded sheet on a sheet stacking surface having an inclined surface and a horizontal surface in order from upstream to downstream in a sheet conveying direction. A downstream end of the inclined surface is higher than an upstream end of the inclined surface with respect to a horizontal plane. The sheet handling apparatus also includes a discharging unit configured to discharge the folded sheet to the sheet stacking unit; a sheet conveying unit configured to convey the discharged sheet from the inclined surface to the horizontal surface; and a conveying force applying unit configured to apply a conveying force to the sheet in contact with an upper surface of the sheet from above the inclined surface.

10 Claims, 10 Drawing Sheets

(51) Int. Cl.
*B65H 29/18* (2006.01)
*B65H 29/66* (2006.01)
*B65H 45/18* (2006.01)

(52) U.S. Cl.
CPC*B65H 29/6609* (2013.01); *B65H 45/18* (2013.01); *B65H 2301/44312* (2013.01); *B65H 2801/27* (2013.01)
USPC ..... 270/32; 270/37; 270/45; 493/444; 493/445

(56) References Cited

U.S. PATENT DOCUMENTS 5,265,731 A * 11/1993 Van de Ven ..... 209/552
5,316,280 A * 5/1994 Watkiss ..... 270/37
7,374,160 B2 * 5/2008 Doi ..... 270/37
7,490,820 B2 * 2/2009 Kobayashi ..... 270/37
7,703,757 B2 * 4/2010 Watanabe et al. ..... 270/32
2004/0254054 A1 12/2004 Suzuki et al.
2006/0180999 A1 8/2006 Suzuki et al.
2007/0120308 A1 * 5/2007 Takemoto et al. ..... 270/37
2008/0211158 A1 * 9/2008 Fukasawa et al. ..... 270/1.01
2008/0284092 A1 11/2008 Suzuki et al.
2009/0152787 A1 6/2009 Sasaki
2010/0148416 A1 * 6/2010 Kayaba et al. ..... 270/4
2011/0140336 A1 * 6/2011 Tanaka ..... 270/37
2011/0229287 A1 9/2011 Suzuki
2012/0087765 A1 4/2012 Suzuki

* cited by examiner

SHEET FOLDING DEVICE HAVING INCLINED STACKING SURFACE

CROSS-REFERENCE TO RELATED APPLICATION

The present application claims priority to and incorporates by reference the entire contents of Japanese Patent Application No. 2011-270127 filed in Japan on Dec. 9, 2011.

BACKGROUND OF THE INVENTION

1. Field of the Invention

The present invention relates to a sheet handling apparatus that performs predetermined processing on a sheet and an image forming system including the sheet handling apparatus.

2. Description of the Related Art

Conventionally widely known are image forming systems including a sheet handling apparatus that performs folding on a sheet on which an image is formed by an image forming apparatus. Examples of the folding performed on a sheet include half-folding for folding a single sheet and saddle-stitching for aligning a bundle of sheets, stitching the bundle of sheets using a stapler, and folding the bundle of sheets. The sheet thus half-folded and the bundle of sheets thus saddle-stitched are conveyed so that the folded part of the sheets is the leading end in a sheet conveying direction. The sheets are sequentially conveyed with at least parts of the sheets overlapping with each other and are stacked on a stacking tray.

Like the sheet handling apparatus disclosed in Japanese Patent No. 4179011, a saddle-stitching discharging unit from which a half-folded or saddle-stitched bundle of sheets is discharged tends to be provided to a lower part of the sheet handling apparatus. Therefore, a stacking tray provided to the saddle-stitching discharging unit is located at a lower position. As a result, if a sheet stacking surface of the stacking tray is horizontally arranged, a user needs to bend down considerably to remove the sheets stacked on the sheet stacking surface. Thus, the operability is deteriorated.

In the sheet handling apparatus disclosed in Japanese Patent Application Laid-open No. 2010-143677, a stacking tray is provided in an inclined manner such that an end of a sheet stacking surface on the downstream side in a sheet conveying direction is located higher than an end on the upstream side. By inclining the sheet stacking surface in this manner, it is possible to arrange the sheet stacking surface at a level facilitating removal of the sheets. Therefore, compared with the case where the sheet stacking surface is horizontally arranged, the user can remove the sheets stacked on the sheet stacking surface without bending down considerably. Thus, the operability can be enhanced.

However, swelling occurs around a folded part of the sheets on which folding is performed. Therefore, if the stacking tray is provided in an inclined manner, the sheets stacked on the sheet stacking surface are likely to collapse compared with the case where the sheet stacking surface is horizontally arranged, resulting in poor stacking.

Therefore, there is a need for a sheet handling apparatus capable of arranging a sheet stacking surface at a level facilitating removal of sheets and of suppressing poor stacking and an image forming system including the sheet handling apparatus.

SUMMARY OF THE INVENTION

It is an object of the present invention to at least partially solve the problems in the conventional technology.

According to an embodiment, there is provided a sheet handling apparatus that includes a sheet folding unit configured to perform folding on a sheet; a sheet stacking unit configured to stack the sheet on which the folding is performed by the sheet folding unit on a sheet stacking surface, the sheet stacking surface having an inclined surface and a nearly horizontal surface in order from upstream to downstream in a sheet conveying direction, the inclined surface being inclined with respect to a horizontal plane such that an end of the inclined surface on a downstream side in the sheet conveying direction is located higher than an end of the inclined surface on an upstream side; a discharging unit configured to discharge the sheet on which the folding is performed by the sheet folding unit to the sheet stacking unit; a sheet conveying unit configured to convey the sheet discharged onto the inclined surface by the discharging unit from the inclined surface to the nearly horizontal surface; and a conveying force applying unit configured to apply a conveying force to the sheet in contact with an upper surface of the sheet, the conveying force applying unit being provided above the inclined surface.

According to another embodiment, there is provided an image forming system that includes an image forming apparatus configured to form an image on a sheet; and the sheet handling apparatus according to the above embodiment to perform predetermined processing on the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a sheet handling apparatus according to the present invention are described below.

Figure 1:
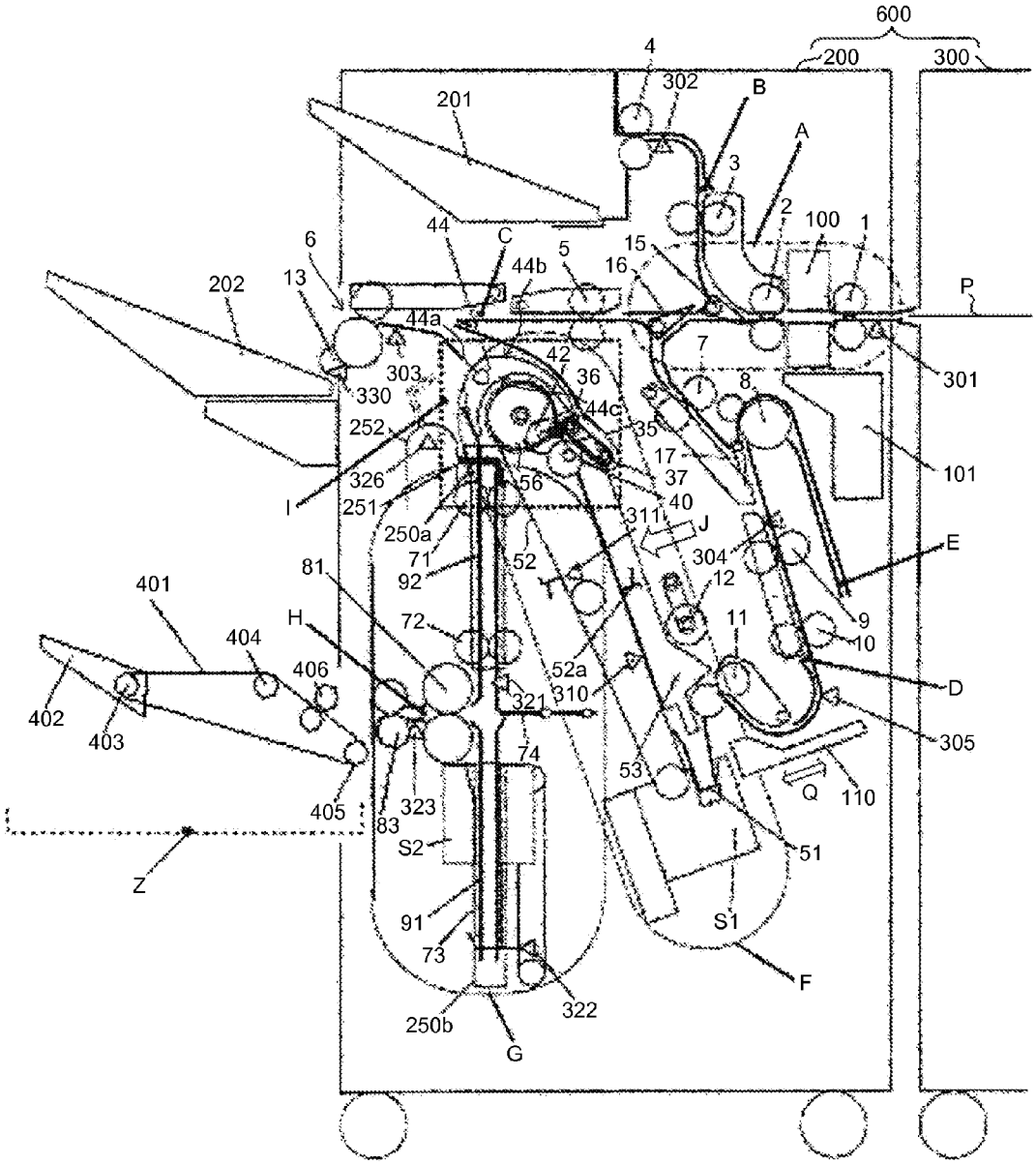
FIG. 1 is a schematic of a configuration of an image forming system formed of a post-processing apparatus and an image forming apparatus according to an embodiment of the present invention.

FIG. 1 is a schematic of a configuration of an image forming system 600 formed of a post-processing apparatus 200 serving as a sheet handling apparatus according to an embodiment of the present invention and of an image forming apparatus 300, such as a copying machine and a printer, that supplies a sheet P that is a sheet material on which an image is formed to the post-processing apparatus 200. Application of the present invention is not limited to the image forming system 600 formed of the image forming apparatus 300 and the post-processing apparatus 200. The present invention can be applied to a sheet handling unit of an image forming system including an image forming unit that forms an image on the sheet P and the sheet handling unit that performs folding on the sheet P.

The image forming apparatus 300 according to the present embodiment is an electrophotography image forming apparatus including an image processing circuit, a photosensitive element, an optical writing device, a developing unit, a transfer unit, and a fixing unit, none of which is particularly illustrated. The image processing circuit converts image data read by a scanning unit of the image forming apparatus 300 serving as a copying machine and image data received from an external apparatus, such as a personal computer, into printable image data and outputs the image data thus converted to the optical writing device. The optical writing device performs optical writing on the photosensitive element based on an image signal output from the image processing circuit to form an electrostatic latent image on the surface of the photosensitive element. The developing unit uses a toner to develop the electrostatic latent image formed on the surface of the photosensitive element by the optical writing. The transfer unit transfers the toner image on the surface of the photosensitive element developed by the developing unit onto the sheet P. The fixing unit fixes the toner image transferred onto the sheet P to the sheet P.

The sheet P to which the toner image is fixed in the image forming apparatus 300 is transferred to the post-processing apparatus 200, and the post-processing apparatus 200 performs desired post-processing. The image forming apparatus 300 according to the present embodiment is an electrophotography image forming apparatus as described above. However, all the publicly known image forming apparatuses, such as an inkjet image forming apparatus and a thermal-transfer image forming apparatus, can serve as the image forming apparatus 300 to be combined with the post-processing apparatus 200.

As illustrated in FIG. 1, the post-processing apparatus 200 is attached to the side of the image forming apparatus 300, and the sheet P discharged from the image forming apparatus 300 is guided to the post-processing apparatus 200.

The post-processing apparatus 200 according to the present embodiment can perform processing, such as punching (a punching unit 100), sheet alignment and end-surface stitching (jogger fences 53 and an end-surface stitching stapler S1), sheet alignment and saddle-stitching (a saddle-stitching unit upper jogger fence 250*a*, a saddle-stitching unit lower jogger fence 250*b*, and a saddle-stitching stapler S2), sorting of the sheets P (a shift tray 202), and half-folding (a folding plate 74 and a pair of folding rollers 81), on the sheet P.

An entrance unit A of the post-processing apparatus 200 is a section into which the sheet P discharged from the image forming apparatus 300 is conveyed first. The entrance unit A includes a single sheet post-processing unit (the punching unit 100 serving as a piercing unit in the present embodiment) that performs post-processing on every single sheet P passing therethrough. A first discharging conveying path B guiding the sheet P to an upper tray 201 is formed above the entrance unit A. A second discharging conveying path C guiding the sheet P to the shift tray 202 is formed on the side (left side in FIG. 1) of the entrance unit A. Furthermore, a stitching conveying path D guiding the sheet P to a stitching tray unit F that performs alignment, staple stitching, and other processing is formed below the entrance unit A in the post-processing apparatus 200.

The entrance unit A is a conveying path arranged on the upstream of the first discharging conveying path B, the second discharging conveying path C, and the stitching conveying path D in a conveying direction. The entrance unit A serves as a conveying path common to all the sheets P transferred from the image forming apparatus 300 to the post-processing apparatus 200. The entrance unit A is provided with an entrance sensor 301 that detects passage of the sheet P received from the image forming apparatus 300. On the downstream of the entrance sensor 301, a pair of entrance rollers 1, the punching unit 100, a punch waste hopper 101, and a pair of pre-bifurcation carriage rollers 2 are arranged in this order. On the downstream of the pair of pre-bifurcation carriage rollers 2 of the entrance unit A, two bifurcating claws of a first bifurcating claw 15 and a second bifurcating claw 16 are arranged.

The first bifurcating claw 15 and the second bifurcating claw 16 are each held in the state illustrated in FIG. 1 by a biasing member, such as a spring, which is not illustrated. In other words, the first bifurcating claw 15 is biased such that the tip thereof faces downward, and the second bifurcating claw 16 is biased such that the tip thereof faces upward. The first bifurcating claw 15 and the second bifurcating claw 16 are each connected to a solenoid, which is not illustrated. By turning on the solenoids, the tips of the first bifurcating claw 15 and the second bifurcating claw 16 are shifted from the state illustrated in FIG. 1. Thus, it is possible to switch conveying paths for the sheet P passing through the positions at which the bifurcating claws are arranged.

By changing the combination of turning on and off of the solenoids for the first bifurcating claw 15 and the second bifurcating claw 16, the post-processing apparatus 200 switches the conveying path for the sheet P passing through the entrance unit A among the first discharging conveying path B, the second discharging conveying path C, and the stitching conveying path D.

To guide the sheet P passing through the entrance unit A into the first discharging conveying path B, the solenoids for both the first bifurcating claw 15 and the second bifurcating claw 16 are turned off to achieve the state illustrated in FIG. 1. When the solenoid, which is not illustrated, connected to the first bifurcating claw 15 is turned off, the tip of the first bifurcating claw 15 faces downward. As a result, it is possible to guide the sheet P passing through the pair of pre-bifurcation carriage rollers 2 into the first discharging conveying path B. The sheet P guided into the first discharging conveying path B passes through a pair of first discharging conveying path carriage rollers 3 and a pair of first ejecting rollers 4 and is discharged onto the upper tray 201. As illustrated in FIG. 1, a first discharging sheet detecting sensor 302 is arranged in the vicinity of the upstream of the pair of first ejecting rollers 4 in the first discharging conveying path B. The first discharging sheet detecting sensor 302 detects whether the sheet P passes through the position at which the first discharging sheet detecting sensor 302 is arranged.

To guide the sheet P passing through the entrance unit A into the stitching conveying path D, the solenoid for the first bifurcating claw 15 is turned on, and the solenoid for the second bifurcating claw 16 is turned off. With this operation, the tip of the first bifurcating claw 15 comes into a state facing upward from the state facing downward illustrated in FIG. 1, and the tip of the second bifurcating claw 16 remains in the state facing upward illustrated in FIG. 1. As a result, it is possible to guide the sheet P passing through the pair of pre-bifurcation carriage rollers 2 into the stitching conveying path D. The sheet P guided into the stitching conveying path D is conveyed to the stitching tray unit F.

To guide the sheet P passing through the entrance unit A into the second discharging conveying path C, the solenoids for both the first bifurcating claw 15 and the second bifurcating claw 16 are turned on. With this operation, the tip of the first bifurcating claw 15 that faces downward in the initial state illustrated in FIG. 1 faces upward, and the tip of the second bifurcating claw 16 that faces upward in the initial state faces downward. As a result, it is possible to guide the sheet P passing through the pair of pre-bifurcation carriage rollers 2 into the second discharging conveying path C. The sheet P guided into the second discharging conveying path C passes through a pair of second discharging conveying path carriage rollers 5 and a pair of second ejecting rollers 6 and is conveyed to the shift tray 202.

As illustrated in FIG. 1, a second discharging sheet detecting sensor 303 is arranged in the vicinity of the upstream of the pair of second ejecting rollers 6 in the second discharging conveying path C. The second discharging sheet detecting sensor 303 detects whether the sheet P passes through the position at which the second discharging sheet detecting sensor 303 is arranged.

On the most downstream of the entrance unit A and the conveying path of the sheet P passing through the second discharging conveying path C in the post-processing apparatus 200, a shift tray discharging unit formed of the shift tray 202 and other components is provided. In addition to the shift tray 202, the shift tray discharging unit includes the pair of second ejecting rollers 6, a returning roller 13, and a shift tray sheet surface detecting sensor 330. The shift tray discharging unit further includes a shift mechanism, which is not illustrated, that reciprocates the shift tray 202 in a direction (a sheet width direction) orthogonal to the conveying direction of the sheet P and a shift tray elevating mechanism, which is not illustrated, that moves up and down the shift tray 202.

In the stitching conveying path D, a pair of stitching conveying path first rollers 7, a sheet guiding claw 17, a prestack sensor 304, a pair of stitching conveying path second rollers 9, and a pair of stitching conveying path third rollers 10 are arranged from the upstream in the conveying direction, for example. As illustrated in FIG. 1, the stitching conveying path D on the downstream of the pair of stitching conveying path third rollers 10 is curved. A curve entrance sheet detecting sensor 305 is arranged at the entrance of the curve and detects whether the sheet P passes through the position at which the curve entrance sheet detecting sensor 305 is arranged. Furthermore, a pair of stitching transferring rollers 11 that transfers the sheet P passing through the stitching conveying path D to the stitching tray unit F is arranged at the exit of the curve.

The sheet guiding claw 17 in the stitching conveying path D is biased by a low-load spring, which is not illustrated, so as to achieve the state illustrated in FIG. 1. In the state illustrated in FIG. 1, the sheet guiding claw 17 blocks the stitching conveying path D between the area provided with the pair of stitching conveying path first rollers 7 and the area provided with the pair of stitching conveying path second rollers 9 and the pair of stitching conveying path third rollers 10. The sheet P conveyed by the pair of stitching conveying path first rollers 7 and other components comes into contact with the sheet guiding claw 17, whereby the sheet guiding claw 17 rotates in the anticlockwise direction in FIG. 1 against the biasing force of the low-load spring. As a result, the sheet P is guided into the area provided with the pair of stitching conveying path second rollers 9 and the pair of stitching conveying path third rollers 10 in the stitching conveying path D. When the trailing end of the sheet P passes through the position at which the sheet guiding claw 17 is arranged, the sheet guiding claw 17 returns to the state illustrated in FIG. 1 by the biasing force of the low-load spring.

In the post-processing apparatus 200, while the stitching tray unit F is performing stitching, the stitching tray unit F cannot receive a subsequent sheet P. If the image forming apparatus 300 stops transferring the sheet P to the post-processing apparatus 200 so as not to supply a new sheet P to the stitching tray unit F while the stitching tray unit F is performing stitching, the productivity of the whole image forming system 600 is reduced. To maintain the productivity of the whole image forming system 600 and gain time for the stitching, the post-processing apparatus 200 performs so-called prestack processing for gaining practical time by temporarily retaining the sheet P and conveying a plurality of sheets P to the stitching tray unit F simultaneously.

To perform the prestack processing, the post-processing apparatus 200 can rotate at least the pair of stitching conveying path second rollers 9 reversely among the pair of stitching conveying path second rollers 9, the pair of stitching conveying path third rollers 10, and the pair of stitching transferring rollers 11 arranged on the downstream of the sheet guiding claw 17 in the conveying direction in the stitching conveying path D. To perform the prestack processing for temporarily retaining the sheet P before conveying the sheet P to the stitching tray unit F, the post-processing apparatus 200 rotates at least the pair of stitching conveying path second rollers 9 reversely after the trailing end of the sheet P passes through the position at which the sheet guiding claw 17 is arranged. At this time, because the conveying path toward the area provided with the pair of stitching conveying path first rollers 7 is blocked by the sheet guiding claw 17, the sheet P conveyed by the reverse rotation of the pair of carriage rollers can be guided into a prestack unit E. Thus, by rotating the pair of carriage rollers reversely after the trailing end of the sheet P passes through the position at which the sheet guiding claw 17 is arranged, the sheet P can be conveyed along a turn guide 8. With this configuration, it is possible to guide the sheet P to the prestack unit E from the trailing end in the conveying direction, retain (prestack) the sheet P, and convey the sheet P to the stitching tray unit F with a sheet P to be subsequently conveyed stacking thereon.

As described above, by repeating the operation for rotating the pair of carriage rollers reversely after the trailing end of the sheet P passes through the position at which the sheet guiding claw 17 is arranged, it is possible to convey two or more sheets P to the stitching tray F in a stacked manner. The timing for rotating the pair of carriage rollers reversely is set to after a timing at which the prestack sensor 304 detects the trailing end of the sheet P passing through the position at which the sheet guiding claw 17 is arranged.

The sheet P guided into the stitching tray unit F vie the entrance unit A and the stitching conveying path D and subjected to post-processing, such as alignment and stapling, in the stitching tray unit F is sorted into a conveying path toward the shift tray 202 or a conveying path toward a sheet stacking tray 401 of a saddle-stitching stacking tray unit Z by a sheet bundle bifurcation guiding member 44.

If the sheet P is sorted into the conveying path toward the shift tray 202, the sheet P is guided to the vicinity of the upstream of the second discharging sheet detecting sensor 303 in the second discharging conveying path C and is discharged to the shift tray 202 by the pair of second ejecting rollers 6 similarly to the sheet P passing through the second discharging conveying path C.

By contrast, if the sheet P is sorted into the conveying path toward the sheet stacking tray 401, the sheet P is transferred to a saddle-stitching and half-folding unit G that performs half-folding and other processing on the sheet P and is subjected to post-processing, such as half-folding, by the folding plate 74 and other components in the saddle-stitching and half-folding unit G. The sheet P on which the post-processing, such as half-folding, is performed passes through an post-half-folding conveying path H and is conveyed to the sheet stacking tray 401 by a pair of lower ejecting rollers 83 through a discharging port. As illustrated in FIG. 1, a lower discharging sheet detecting sensor 323 is arranged in the vicinity of the upstream of the pair of lower ejecting rollers 83 in the post-half-folding conveying path H and detects whether the sheet P passes through the position at which the lower discharging sheet detecting sensor 323 is arranged.

The stitching tray unit F will now be described.

Figure 2:
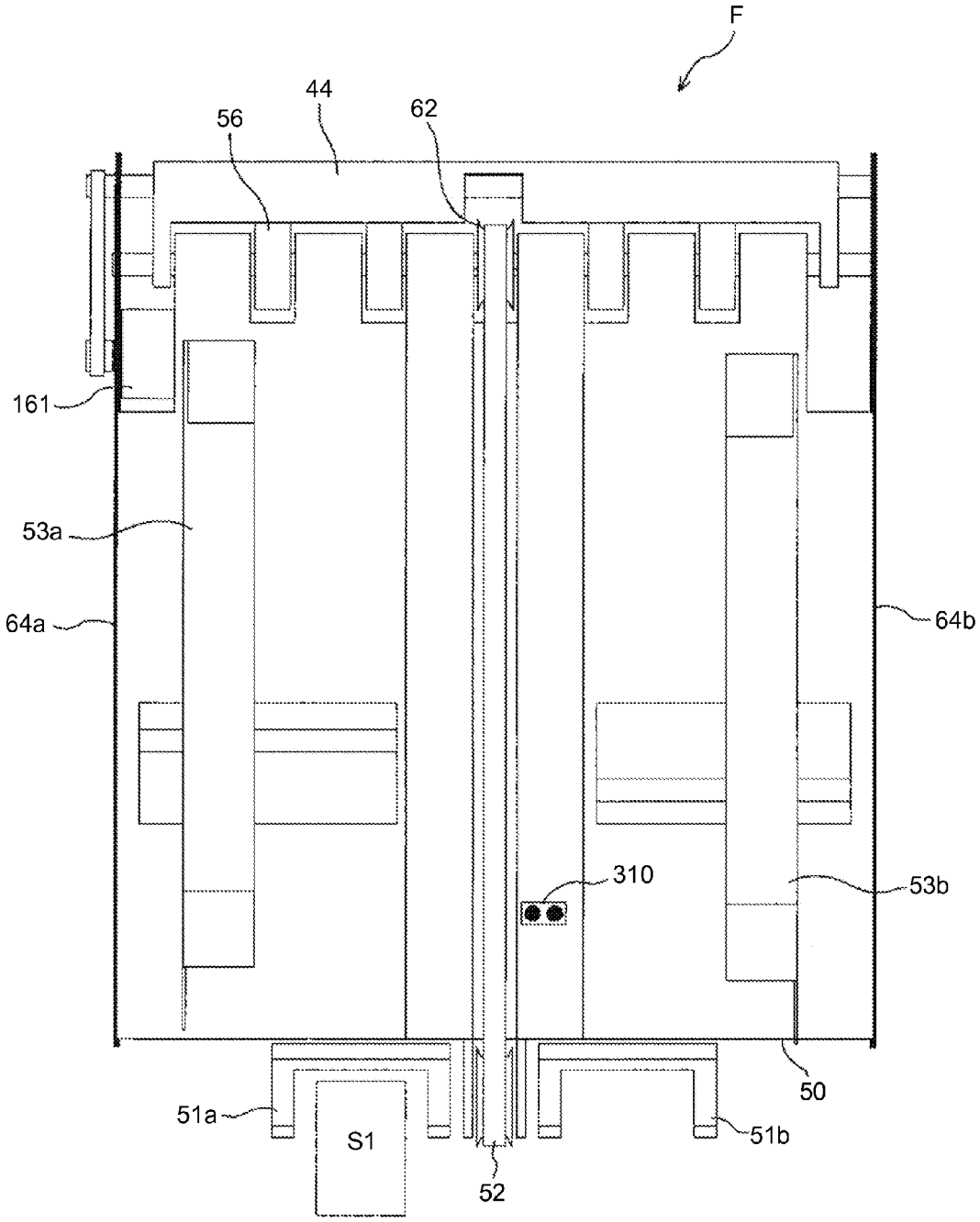
FIG. 2 is a schematic of a configuration of a stitching tray unit viewed from a stacking surface side.
Figure 3A:
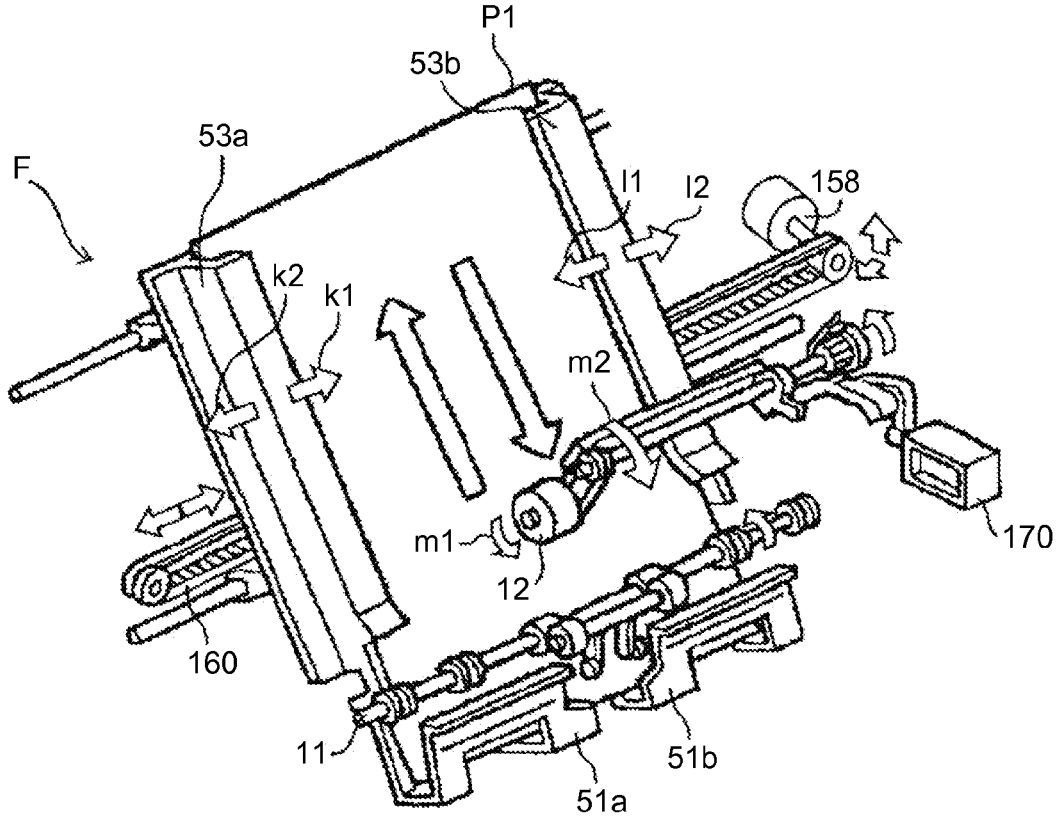
FIG. 3A is a perspective view for explaining the stitching tray unit and an auxiliary mechanism thereof.
Figure 3B:
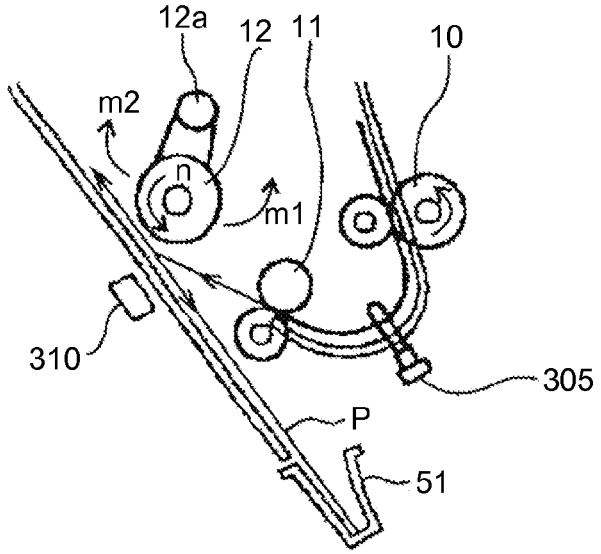
FIG. 3B is a partial enlarged view of FIG. 3A.

FIG. 2 is a schematic of a configuration of the stitching tray unit F viewed from a stacking surface side of a staple tray 50 (an arrow J direction in FIG. 1). FIG. 3A is a perspective view of a schematic configuration of members constituting the stitching tray unit F and an auxiliary mechanism thereof. FIG. 3B is an enlarged side view of the vicinity of a tapping roller 12. As illustrated in FIG. 2, a front side plate 64*a* and a rear side plate 64*b* are arranged on both ends of the stitching tray unit F in the sheet width direction.

The sheets P guided into the stitching tray unit F by the pair of stitching transferring rollers 11 are sequentially stacked on the stitching tray unit F as illustrated in FIG. 3. Every time the sheet P reaches the stitching tray unit F, the tapping roller 12 aligns the sheets P in the longitudinal direction (conveying direction), and the jogger fences 53 (a first jogger fence 53*a* and a second jogger fence 53*b*) aligns the sheets P in the lateral direction (sheet width direction orthogonal to the conveying direction).

As illustrated in FIG. 1, FIG. 2, and FIG. 3B, a tray unit sheet detecting sensor 310 is provided to the stitching tray unit F and detects whether the sheet P is stacked on the position at which the tray unit sheet detecting sensor 310 is arranged.

The tapping roller 12 is caused to swing like a pendulum about a tapping fulcrum 12*a* by a tapping solenoid 170 as indicated by an arrow m1 and an arrow m2 in FIG. 3. The tapping roller 12 itself rotates in the anticlockwise direction as indicated by an arrow n in FIG. 3B. With this configuration, a conveying force generated by the rotation of the tapping roller 12 intermittently affects the sheet P transferred into the stitching tray unit F, thereby causing the sheet P to abut on trailing-end reference fences 51*a* and 51*b*.

The jogger fences 53 are provided in a pair in the sheet width direction as illustrated in FIG. 2 and FIG. 3A. The jogger fences 53 are driven by a jogger motor 158 that is reversible via a timing belt 160 and reciprocates in the sheet width direction.

The post-processing apparatus 200 includes a first jogger motor and a first timing belt that transmit a driving force to the first jogger fence 53*a* and a second jogger motor and a second timing belt that transmit a driving force to the second jogger fence 53*b*. The first jogger fence 53*a* and the second jogger fence 53*b* have individual driving sources in this manner and can operate individually.

The reciprocation of the jogger fences 53 in the sheet width direction will now be described.

If the length of the sheet P to be aligned in the sheet width direction is the sheet width, the distance between the first jogger fence 53*a* and the second jogger fence 53*b* in the sheet width direction is a width slightly wider than the sheet width in a standby state until the sheet P is conveyed. If the sheet P is transferred into the stitching tray unit F and reaches the space between the two jogger fences 53, the first jogger fence 53*a* moves in a k1 direction in FIG. 3A, and the second jogger fence 53*b* moves in an l1 direction in FIG. 3A. If the distance between the two jogger fences 53 in the sheet width direction becomes equal to the sheet width, the jogger motor 158 (the first jogger motor and the second jogger motor) is rotated reversely. As a result, the first jogger fence 53*a* moves in a k2 direction in FIG. 3A, and the second jogger fence 53*b* moves in an l2 direction in FIG. 3A until the distance between the two jogger fences 53 in the sheet width direction becomes equal to the distance in the standby state.

This control causes the two jogger fences 53 to move inward simultaneously and move outward simultaneously, thereby achieving reciprocation of the jogger fences 53. By performing the reciprocation described above once or several times every time the sheet P is transferred into the stitching tray unit F, a bundle of sheets P (hereinafter, also referred to as a sheet bundle P1) stacked on the stitching tray unit F is aligned in the sheet width direction.

While the two jogger fences 53 reciprocate to align the sheet bundle P1 in the sheet width direction in the present embodiment, the movement of the jogger fences 53 to align the sheet bundle P1 in the sheet width direction is not limited thereto. One of the two jogger fences 53 may stop, and only the other of the jogger fences 53 may reciprocate in the sheet width direction.

The post-processing apparatus 200 includes the end-surface stitching stapler S1 serving as a stitching unit that performs stitching on a trailing end portion of the sheet bundle P1 stacked on the stitching tray unit F. The end-surface stitching stapler S1 can move in the sheet width direction of the sheet bundle P1 thus aligned. In the post-processing apparatus 200, the end-surface stitching stapler S1 serving as the stitching unit is driven based on a staple signal supplied from a control device, which is not illustrated, in an interval between jobs to perform stitching on the sheet bundle P1 for which alignment is completed. The interval between jobs is an interval from when a sheet P serving as the last sheet of the sheet bundle P1 being stacked on the stitching tray unit F reaches the stitching tray unit F to when a sheet P serving as the first sheet of a subsequent sheet bundle P1 reaches the stitching tray unit F.

Figure 5:
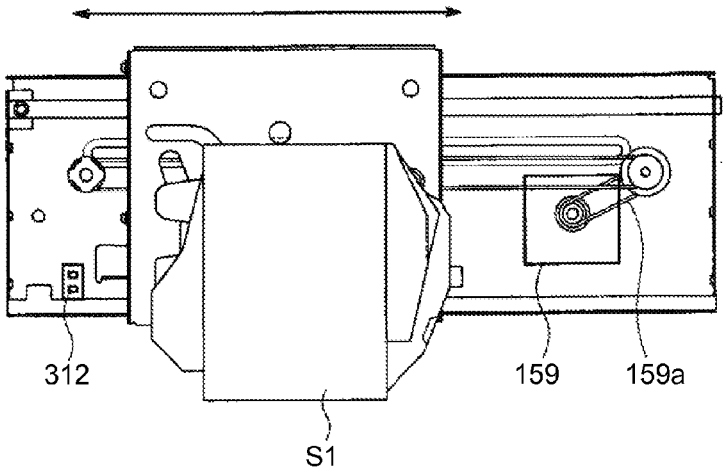
FIG. 5 is a perspective view for explaining a moving mechanism of a stapler.

FIG. 5 is a side view of a stapler width direction moving mechanism. As illustrated in FIG. 5, the end-surface stitching stapler S1 is driven by a stapler moving motor 159 that is reversible via a timing belt 159*a* and moves in the sheet width direction to stitch a predetermined position on the sheet trailing end portion. On one end of the movement range, a stapler movement HP sensor 312 that detects a home position (HP) of the end-surface stitching stapler S1 is provided. The stitching position in the sheet width direction is controlled by the amount of movement of the end-surface stitching stapler S1 from the HP. The end-surface stitching stapler S1 can perform stitching at one position or a plurality of positions (typically, two positions) on the sheet trailing end portion. The end-surface stitching stapler S1 can move at least across the full width of the sheet trailing end supported by the trailing-end reference fences 51*a* and 51*b*. Furthermore, the end-surface stitching stapler S1 can move to the front side of the apparatus to the maximum for replacement of staples, which facilitates a user's replacing staples.

On the upper right of the end-surface stitching stapler S1 in FIG. 1, a trailing-end pressing lever 110 is provided. The trailing-end pressing lever 110 is arranged at a position facing the lower end of the trailing-end reference fences 51 (51*a*, 51*b*) so as to press the trailing end of the sheet bundle P1 housed in the trailing-end reference fences 51. The trailing-end pressing lever 110 can reciprocate in a direction nearly perpendicular to the placing surface of the stitching tray unit F as indicated by an arrow Q in FIG. 1.

In the stitching tray unit F, the tapping roller 12 aligns the sheets P in the longitudinal direction (sheet conveying direction) every time the sheet P reaches the stitching tray unit F. If the trailing end of the sheet P stacked on the stitching tray unit F curls or if the sheet P is soft, however, the trailing end tends to be buckled and swelled by the own weight of the sheet P. Furthermore, as the number of stacked sheets increases, the gap into which the subsequent sheet P enters in the trailing-end reference fence 51 is made smaller, thereby deteriorating the alignment in the longitudinal direction. To reduce swelling of the trailing end of the sheet P housed in the stitching tray unit F and to facilitate entering of the sheet P that newly reaches the stitching tray unit F into the trailing-end reference fences 51, a trailing end pressing mechanism is provided. The trailing-end pressing lever 110 directly presses the sheet P.

The sheet bundle P1 thus stitched is discharged to the shift tray 202 by a discharging belt 52. The discharging operation of the sheet bundle P1 performed by the discharging belt 52 will now be described.

Figure 4A:
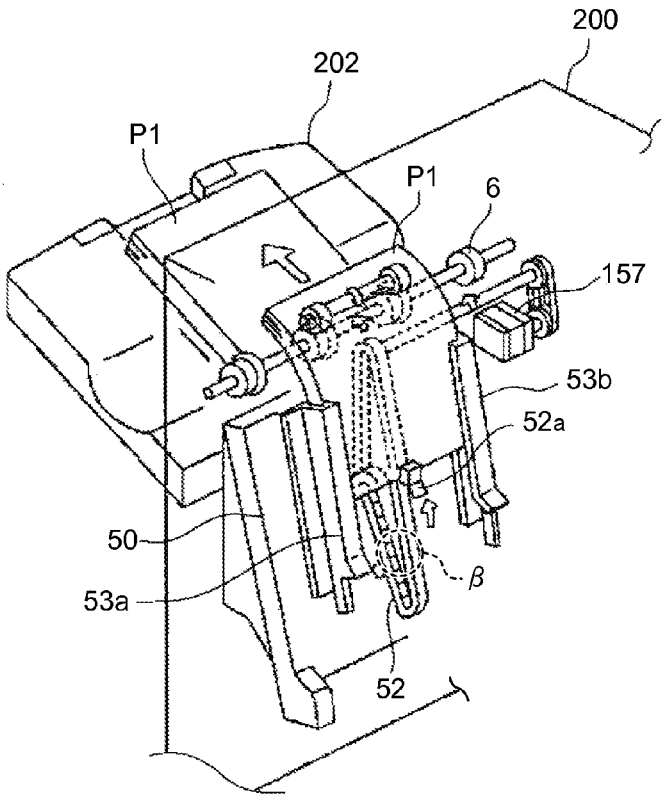
FIG. 4A is a perspective view for explaining a discharging operation of a sheet bundle performed by a discharging belt.
Figure 4B:
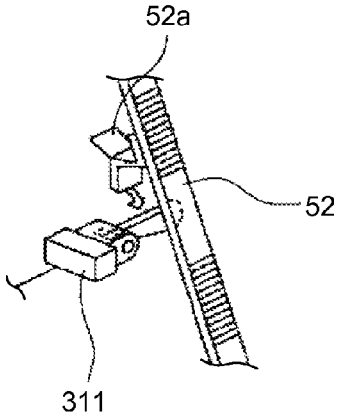
FIG. 4B is a partial enlarged view of FIG. 4A.

FIG. 4A is a perspective view for explaining the discharging operation performed by the discharging belt 52. FIG. 4B is an enlarged perspective view of the vicinity of a discharging belt HP sensor 311 (area β in FIG. 4A).

The discharging belt 52 is positioned at the center of alignment in the sheet width direction as illustrated in FIG. 2 and is stretched across three pulleys 62 as illustrated in FIG. 1. By driving a discharging motor 157, the pulley 62 supporting the upper end of the discharging belt 52 is driven to rotate, and the driving force is transmitted to the discharging belt 52, thereby causing the discharging belt 52 to move endlessly.

The discharging belt 52 is provided with a discharging claw 52*a* protruding above the outer circumference. When the discharging motor 157 is driven to cause the discharging belt 52 to rotate in the anticlockwise direction in FIG. 1, the trailing end (lower end) of the sheet bundle P1 thus stitched abuts on the discharging claw 52*a*. Subsequently, the discharging belt 52 further moves endlessly, whereby the sheet bundle P1 is lifted by the discharging claw 52*a* and is discharged from the stitching tray unit F.

Furthermore, as illustrated in FIG. 1 and FIG. 2, a plurality of discharging rollers 56 are arranged coaxially with the pulley 62 that transmits the driving force to the discharging belt 52 and symmetrically in the sheet width direction with the discharging belt 52 interposed therebetween. The discharging rollers 56 are rotatably provided to a driving shaft that transmits the driving force from the discharging motor 157 to the pulley 62 and function as driven rollers used for discharging the sheet bundle P1.

The discharging operation of the sheet bundle P1 from the stitching tray unit F performed by the discharging belt 52 can also be performed on an yet-to-be-stitched sheet bundle on which no stitching is performed after the alignment. Furthermore, the destination to which the sheet bundle P1 discharged from the stitching tray unit F is conveyed is not limited to the shift tray 202. The sheet stacking tray 401 may be set as the destination, which will be described later.

As illustrated in FIG. 4B, the HP of the discharging claw 52*a* is detected by the discharging belt HP sensor 311. The discharging belt HP sensor 311 is turned on and off by the discharging claw 52*a* provided to the discharging belt 52. On the outer circumference of the discharging belt 52, two discharging claws 52*a* are arranged at positions that equally divide the perimeter and alternately convey the sheet bundle P1 housed in the stitching tray unit F.

Furthermore, by rotating the discharging belt 52 reversely as needed, the leading end of the sheet bundle P1 housed in the stitching tray unit F in the conveying direction can be aligned by the back surface of the discharging claw 52*a* opposite to the discharging claw 52*a* that is ready for moving the sheet bundle P1.

A sheet bundle conveying path switching unit I is provided on the downstream of the stitching tray unit F in the sheet conveying direction. The sheet bundle conveying path switching unit I switches the conveying path for the sheet bundle P1 discharged from the stitching tray unit F between a conveying path to convey the sheet bundle P1 to the saddle-stitching and half-folding unit G and a conveying path to convey the sheet bundle P1 to the shift tray 202. The sheet bundle conveying path switching unit I is formed of a sheet bundle conveying mechanism 35 that applies a conveying force to the sheet bundle P1 lifted by the discharging claw 52*a*, the discharging rollers 56 that turn the sheet bundle P1, and the sheet bundle bifurcation guiding member 44 that guides the sheet bundle P1 to turn, for example.

The configuration of the members of the sheet bundle conveying path switching unit I will now be described. A driving force of a sheet bundle conveying driving shaft 37 is transmitted to a sheet bundle carriage roller 36 of the sheet bundle conveying mechanism 35 via a sheet bundle conveying timing belt. The sheet bundle carriage roller 36 and the sheet bundle conveying driving shaft 37 are connected and supported by an arm, and the sheet bundle carriage roller 36 can rotate about the sheet bundle conveying driving shaft 37 serving as a rotation fulcrum. The sheet bundle carriage roller 36 of the sheet bundle conveying mechanism 35 is driven to swing by a sheet bundle conveying member swinging cam 40. The sheet bundle conveying member swinging cam 40 swings about a swinging shaft when a motor, which is not illustrated, is driven.

In the sheet bundle conveying mechanism 35, a sheet bundle conveying driven roller 42 is arranged at a position facing the sheet bundle carriage roller 36. The sheet bundle conveying driven roller 42 is pressed against the sheet bundle carriage roller 36 by an elastic member, and the sheet bundle P1 is sandwiched between the sheet bundle conveying driven roller 42 and the sheet bundle carriage roller 36. By driving the sheet bundle carriage roller 36 to rotate in the clockwise direction in FIG. 1, a conveying force is applied to the sheet bundle P1.

The sheet bundle bifurcation guiding member 44 is supported rotatably about a bifurcation guiding shaft 44*a*. By transmitting a driving force from a sheet bundle bifurcation guide driving motor 161 illustrated in FIG. 2, the sheet bundle bifurcation guiding member 44 rotates about the bifurcation guiding shaft 44*a*. Among the surfaces of the sheet bundle bifurcation guiding member 44, the upper surface is an upper surface 44*b* of the sheet bundle bifurcation guiding member 44, and the lower surface facing the discharging rollers 56 is a lower surface 44*c* of the sheet bundle bifurcation guiding member 44.

To convey the sheet bundle P1 from the stitching tray unit F to the saddle-stitching and half-folding unit G, the sheet bundle P1 lifted by the discharging claw 52*a* is turned at the upper end of the discharging belt 52 and is conveyed downward. The conveying path that turns the sheet bundle P1 downward in this manner is formed between the upper surfaces of the discharging rollers 56 and the lower surface 44*c* of the sheet bundle bifurcation guiding member 44.

To convey the sheet bundle P1 from the stitching tray unit F to the shift tray 202, the sheet bundle bifurcation guiding member 44 rotates about the bifurcation guiding shaft 44*a* in the clockwise direction in FIG. 1. As a result, the space between the upper surface 44*b* of the sheet bundle bifurcation guiding member 44 and a guide plate facing the upper surface 44*b* functions as a conveying path.

To convey the sheet bundle P1 from the stitching tray unit F to the saddle-stitching and half-folding unit G, the trailing end of the sheet bundle P1 aligned in the stitching tray unit F is lifted by the discharging claw 52*a* and is sandwiched between the sheet bundle carriage roller 36 of the sheet bundle conveying mechanism 35 and the sheet bundle conveying driven roller 42, and a conveying force is applied to the sheet bundle P1. At a timing when the leading end of the sheet bundle P1 lifted by the discharging claw 52*a* passes through the position at which the sheet bundle carriage roller 36 and the sheet bundle conveying driven roller 42 sandwich the sheet bundle P1, the sheet bundle carriage roller 36 stands by at a position where the sheet bundle carriage roller 36 does not collide with the leading end of the sheet bundle P1.

If the leading end of the sheet bundle P1 passes through the position at which the sheet bundle carriage roller 36 and the sheet bundle conveying driven roller 42 sandwich the sheet bundle P1, the sheet bundle carriage roller 36 is brought into contact with the surface of the sheet bundle P1. Subsequently, a conveying force generated by rotation of the sheet bundle carriage roller 36 is applied to the sheet bundle P1. The sheet bundle P1 to which the conveying force is applied by the sheet bundle carriage roller 36 passes through the turn conveying path formed between the upper surfaces of the discharging rollers 56 and the lower surface 44*c* of the sheet bundle bifurcation guiding member 44. Thus, the sheet bundle P1 is conveyed to the saddle-stitching and half-folding unit G.

As illustrated in FIG. 1, the saddle-stitching and half-folding unit G is provided on the downstream of the sheet bundle conveying path switching unit I in the sheet conveying direction. In the saddle-stitching and half-folding unit G, the conveying path for the sheet bundle P1 conveyed from the sheet bundle conveying path switching unit I is formed nearly vertical. At the center of the conveying path in the vertical direction, a half-folding mechanism formed of the folding plate 74 and other components is arranged. Furthermore, a saddle-stitching unit upper sheet bundle conveying guide plate 92 is arranged above the half-folding mechanism, and a saddle-stitching unit lower sheet bundle conveying guide plate 91 is arranged below the half-folding mechanism.

A pair of saddle-stitching unit upper sheet bundle carriage rollers 71 is arranged at the upper part of the saddle-stitching unit upper sheet bundle conveying guide plate 92. A pair of saddle-stitching unit lower sheet bundle carriage rollers 72 is arranged at the lower part of the saddle-stitching unit upper sheet bundle conveying guide plate 92. Furthermore, the saddle-stitching unit upper jogger fence 250*a* is arranged along both side surfaces of the saddle-stitching unit upper sheet bundle conveying guide plate 92 in the sheet width direction across the pair of saddle-stitching unit upper sheet bundle carriage rollers 71 and the pair of saddle-stitching unit lower sheet bundle carriage rollers 72. Similarly, the saddle-stitching unit lower jogger fence 250*b* is arranged along both side surfaces of the saddle-stitching unit lower sheet bundle conveying guide plate 91 in the sheet width direction.

The saddle-stitching stapler S2 is arranged at the position where the saddle-stitching unit lower jogger fence 250*b* is provided.

The saddle-stitching unit upper jogger fence 250*a* and the saddle-stitching unit lower jogger fence 250*b* are driven by a driving mechanism, which is not illustrated, and align the sheet bundle P1 in the saddle-stitching and half-folding unit G in the sheet width direction. The saddle-stitching stapler S2 is arranged such that a clincher and a driver make a pair in a manner sandwiching the conveying path formed by the saddle-stitching unit lower sheet bundle conveying guide plate 91 therebetween. Two pairs of the clincher and the driver are arranged at a predetermined interval in the sheet width direction.

A saddle-stitching unit movable leading-end fence 73 is arranged in a manner crossing the saddle-stitching unit lower sheet bundle conveying guide plate 91. The saddle-stitching unit movable leading-end fence 73 can be moved in the sheet conveying direction (vertical direction in FIG. 1) by a driving mechanism including a leading-end fence timing belt driven by a driving source, which is not illustrated.

The driving mechanism of the saddle-stitching unit movable leading-end fence 73 is formed of a driving pulley and a driven pulley across which the leading-end fence timing belt 73 is stretched and a stepping motor serving as a driving source, which is not illustrated, that drives the driving pulley. Furthermore, a leading-end fence HP sensor 322 that detects the HP of the saddle-stitching unit movable leading-end fence 73 is arranged at the lower end of the leading-end fence timing belt.

A trailing-end tapping claw 251 and a driving mechanism thereof are provided to the upper end of the saddle-stitching unit upper sheet bundle conveying guide plate 92. The trailing-end tapping claw 251 can be reciprocated in a direction abutting on the trailing end of the sheet bundle P1 stacked in the saddle-stitching and half-folding unit G and a direction away from the trailing end of the sheet bundle P1 by a driving mechanism including a trailing-end tapping claw timing belt 252 driven by a driving source, which is not illustrated.

While a part of the upper end of the trailing-end tapping claw timing belt 252 alone is illustrated in FIG. 1, the trailing-end tapping claw timing belt 252 is a looped endless belt like other timing belts. Furthermore, as illustrated in FIG. 1, a trailing-end tapping claw HP sensor 326 is arranged inside of the upper end of the trailing-end tapping claw timing belt 252 and detects the HP of the trailing-end tapping claw 251. The HP of the trailing-end tapping claw 251 is the position indicated by a dashed-two dotted line in FIG. 1. At a timing when the sheet bundle P1 is conveyed from the stitching tray unit F to the saddle-stitching and half-folding unit G, the trailing-end tapping claw 251 is located at the HP. Subsequently, after the front end of the sheet bundle P1 conveyed into the saddle-stitching and half-folding unit G abuts on the saddle-stitching unit movable leading-end fence 73, the trailing-end tapping claw timing belt 252 is driven. As a result, the trailing-end tapping claw 251 is caused to abut on the trailing end of the sheet bundle P1, whereby the sheet bundle P1 is aligned in the sheet conveying direction.

The half-folding mechanism is provided nearly at the center of the saddle-stitching and half-folding unit G and is formed of the folding plate 74, the pair of folding rollers 81, and the post-half-folding conveying path H through which the sheet bundle P1 thus half-folded is conveyed. The post-half-folding conveying path H is provided with the lower discharging sheet detecting sensor 323 that detects passage of the sheet bundle P1 thus half-folded. A folded-part arrival sensor 321 that detects arrival of the sheet bundle P1 at the half-folding position is arranged above the folding plate 74.

Figure 6A:
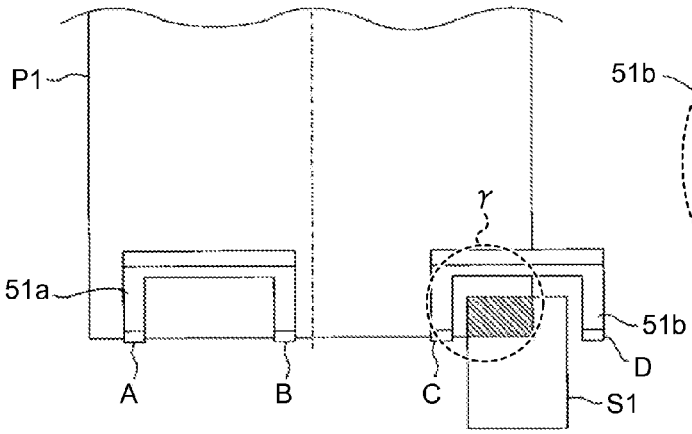
FIG. 6A is a view illustrating a state where stitching is performed on sheets stacked on the stitching tray unit using an end-surface stitching stapler.
Figure 6B:
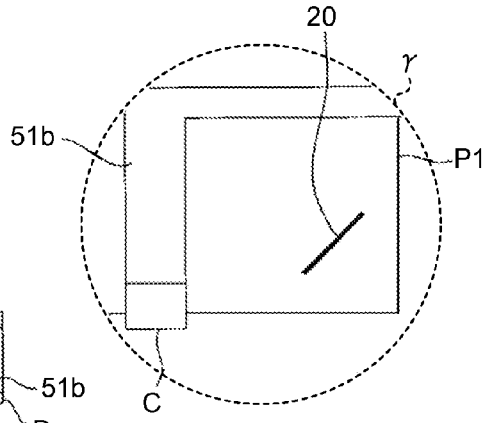
FIG. 6B is a partial enlarged view of FIG. 6A.

FIG. 6A is a view illustrating a state where stitching is performed on the sheets P stacked on the stitching tray unit F using the end-surface stitching stapler S1. FIG. 6B is an enlarged view of area γ in FIG. 6A.

As illustrated in FIG. 6A, the sheet trailing end is brought into contact with at least two stack surfaces among a stack surface A and a stack surface B of the trailing-end reference fence 51*a* and a stack surface C and a stack surface D of the trailing-end reference fence 51*b*, whereby the sheet bundle P1 is stacked in the stitching tray unit F. Subsequently, the end-surface stitching stapler S1 moved to a corner on the right side of the trailing end of the sheet bundle P1, which is a predetermined stitching position on the sheet end, drives a staple 20 in the corner on the right side of the trailing end of the sheet bundle P1. Thus, as illustrated in FIG. 6B, the sheet bundle P1 stacked in the stitching tray unit F is bound.

Figure 7A:
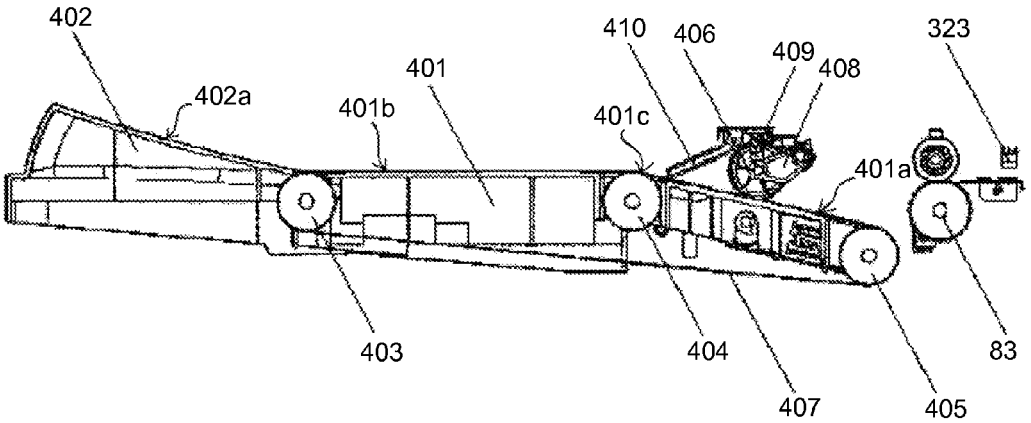
FIG. 7A is a schematic sectional view of a saddle-stitching stacking tray unit Z.
Figure 7B:
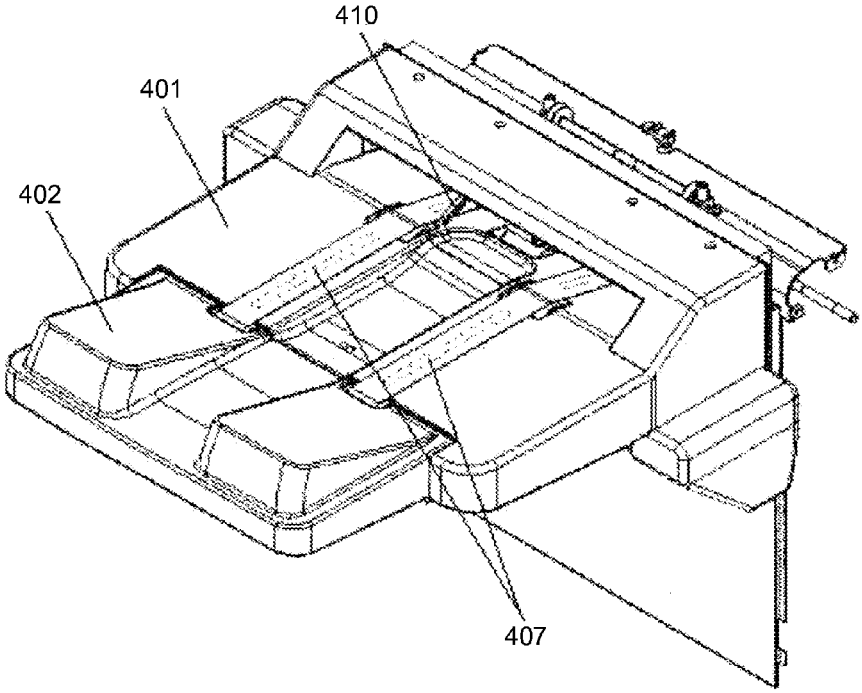
FIG. 7B is a schematic perspective view of the saddle-stitching stacking tray unit Z.
Figure 8:
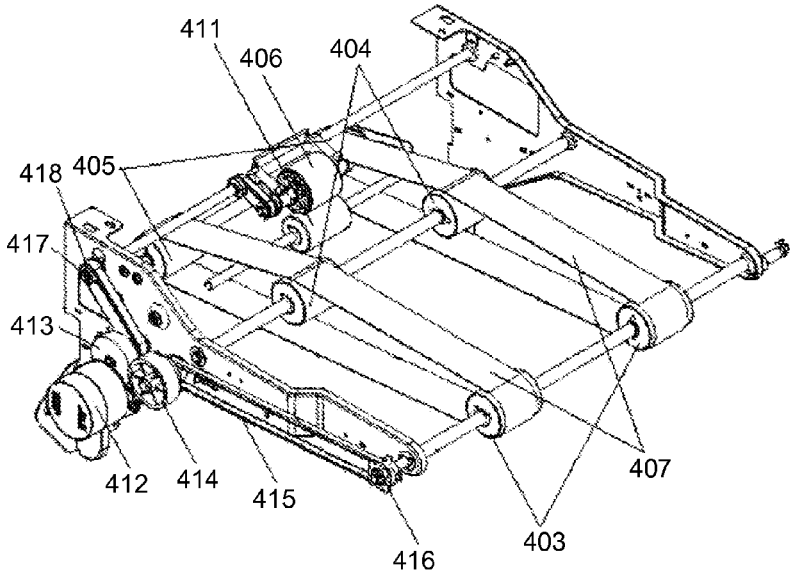
FIG. 8 is a schematic perspective view of an internal constitution of the saddle-stitching stacking tray unit Z.

FIG. 7A is a schematic sectional view of the saddle-stitching stacking tray unit Z according to the present embodiment. FIG. 7B is a schematic perspective view of the saddle-stitching stacking tray unit Z. FIG. 8 is a schematic perspective view of an internal constituent of the saddle-stitching stacking tray unit Z.

The saddle-stitching stacking tray unit Z is formed of the sheet stacking tray 401, a sheet stacking auxiliary tray 402, a conveying driving roller 406, and a conveying belt 407, for example. The sheet stacking surface of the sheet stacking tray 401 includes an inclined surface 401*a* inclined with respect to a horizontal plane such that an end on the downstream side in the sheet conveying direction is located higher than an end on the upstream side, a curved surface 401*c*, and a nearly horizontal surface 401*b* in this order from the upstream to the downstream in the sheet conveying direction. The inclined surface 401*a*, the curved surface 401*c*, and the nearly horizontal surface 401*b* form a continuous surface. The end of the inclined surface 401*a* on the upstream side in the sheet conveying direction is positioned lower than the sheet discharging port of the pair of lower ejecting rollers 83, and the inclined surface 401*a* is inclined with the end on the sheet discharging port side facing downward. The length of the nearly horizontal surface 401*b* in the sheet conveying direction is longer than that of the inclined surface 401*a*. While the nearly horizontal surface 401*b* is preferably horizontal, inclination is acceptable as long as the inclination angle of the surface with respect to the horizontal plane is up to nearly 10 degrees.

In the sheet stacking tray 401, two conveying belts 407 serving as a sheet conveying unit are rotatably stretched along the surface of the sheet stacking tray 401 across a conveying belt driving roller 403, a conveying belt driven roller 404, and a conveying belt driven roller 405 each rotatably supported.

The conveying belt 407 is preferably made of Chloropolyethylene, which has high friction, for example. The belt width of the conveying belt 407 is set to nearly 40 mm, and the gap between the two conveying belts 407 is set to a range falling within a short-side width of a B5-sized sheet capable of being saddle-stitched in the post-processing apparatus 200. While the two conveying belts 407 are stretched across the conveying belt driving roller 403, the conveying belt driven roller 404, and the conveying belt driven roller 405 in the present embodiment, the number of conveying belts 407 thus stretched may be a plurality more than three. Alternatively, one wide belt may be stretched.

The conveying driving roller 406 that comes into contact with the upper surface of the sheet P to be stacked and applies a conveying force thereto in a rotatable manner is provided above the inclined surface 401*a* of the sheet stacking tray 401. The conveying driving roller 406 applies a conveying force strong enough for the sheet P to ascend the inclined surface 401*a*. Furthermore, the conveying driving roller 406 and the inclined surface 401*a* sandwich the sheet P therebetween, thereby suppressing a descent of the sheet P along the inclined surface 401*a*. The conveying driving roller 406 is preferably made of an ethylene-propylene (EP) rubber, which has high friction, for example. Furthermore, a conveying driven roller 411 that comes into contact with the conveying driving roller 406 and is driven to rotate by rotation of the conveying driving roller 406 is provided at the position facing the conveying driving roller 406 in the sheet stacking tray 401. The conveying driving roller 406 is swingably supported by a stacking tray receiving guiding member 408 and is pressed against the conveying driven roller 411 by a biasing member 409, such as a compressed spring or a coil spring.

The rotation directions of the conveying belt driving roller 403 and the conveying driving roller 406 are opposite to each other. A driving force is transmitted from the same driving source 412 to the conveying belt driving roller 403 and the conveying driving roller 406 via a driving force transmitting mechanism. The conveying belt driving roller 403 and the conveying driving roller 406 need to rotate at similar speeds on the roller peripheral surfaces. The driving force transmitting mechanism is formed of a gear 413, a gear 414, a timing belt 415, a timing pulley 416, a timing belt 417, and a timing pulley 418, for example. The driving force transmitting mechanism decelerates the driving force supplied from the driving source 412 and transmits the driving force to the conveying belt driving roller 403 and the conveying driving roller 406. If a motor capable of detecting the rotation rate, such as a stepping motor or a direct-current (DC) brushless motor with an encoder, is used as the driving source 412, the configuration can be made simpler with no need for providing a separate sensor.

In the area of the inclined surface 401*a* and the curved surface 401*c* of the sheet stacking tray 401, by sequentially conveying the sheets P with parts of the sheets P overlapping with each other, it is possible to suppress entering of a folded part serving as the leading end of a subsequent sheet P into an opening serving as the trailing end of a prior sheet P.

The sheet stacking auxiliary tray 402 is provided on the downstream of the nearly horizontal surface 401*b* of the sheet stacking tray 401 in the sheet conveying direction. The sheet stacking auxiliary tray 402 includes an inclined surface 402*a* whose end on the downstream side in the sheet conveying direction is located higher than the nearly horizontal surface 401*b* of the sheet stacking tray 401. The sheet stacking tray 401 has a function to prevent the sheet P from falling and to restrict the position of the leading sheet P when the conveying driving roller 406 and the conveying belt 407 sequentially convey the sheet P and a large number of sheets P are stacked on the sheet stacking tray 401.

Figure 9:
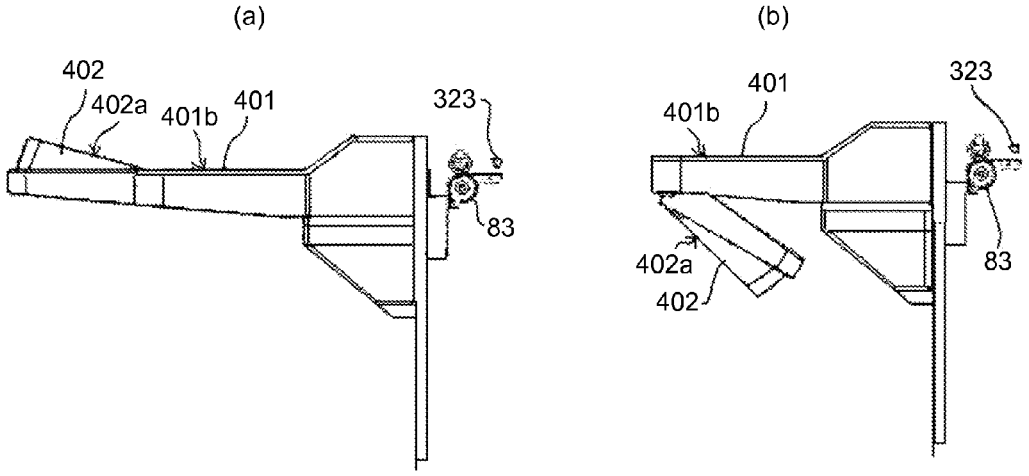
FIG. 9 illustrates a state where a sheet stacking auxiliary tray is taken out from a retracting position under the sheet stacking tray, and a state where the sheet stacking auxiliary tray is retracted in the retracting position under the sheet stacking tray.
Figure 10:
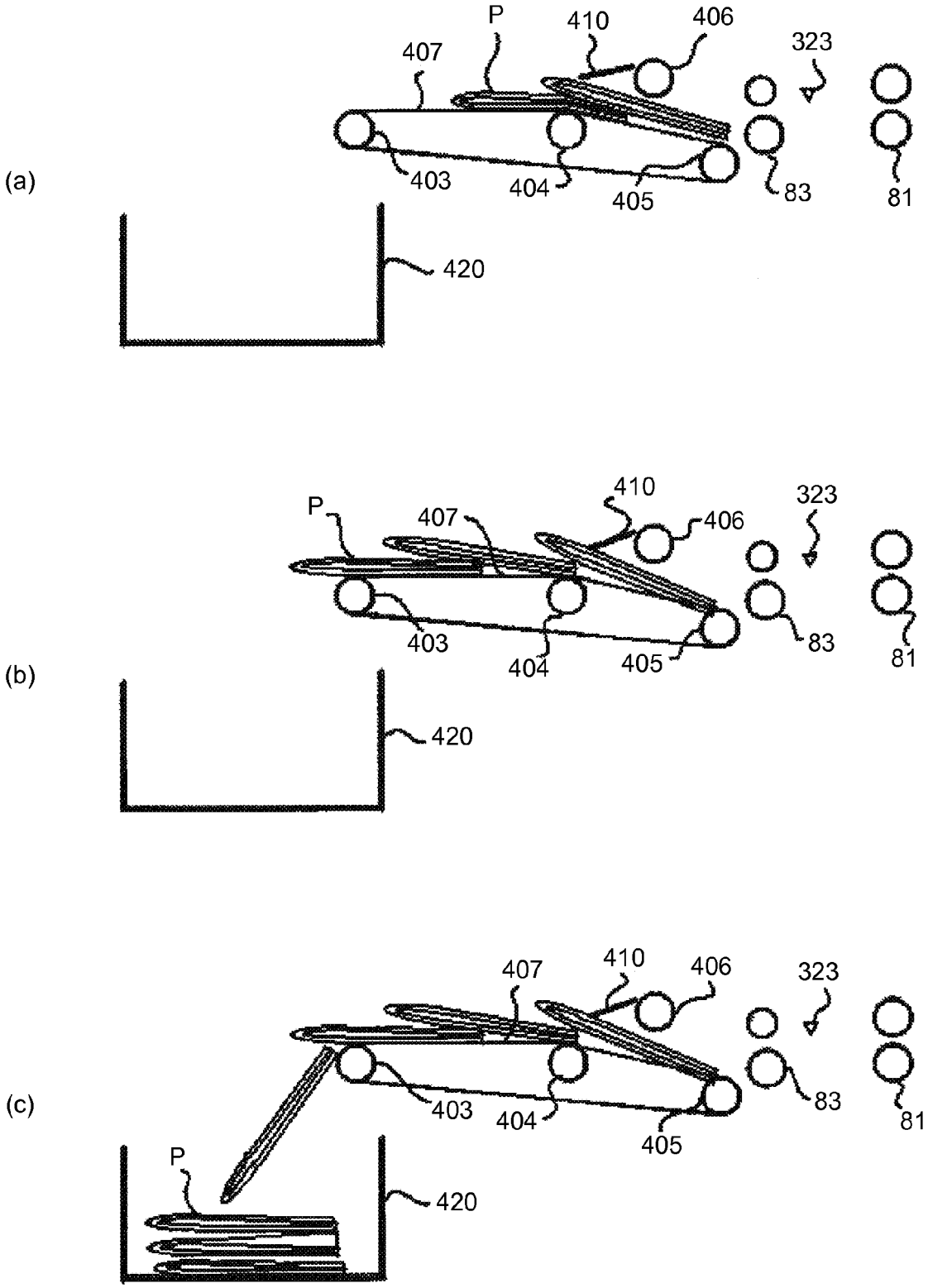
FIG. 10 is a view for explaining the case where sheets are accumulated in a sheet stacking box.

In FIG. 9, (a) is a view illustrating a state where the sheet stacking auxiliary tray is taken out from a retracting position under the sheet stacking tray 401. In FIG. 9, (b) is a view illustrating a state where the sheet stacking auxiliary tray 402 is retracted in the retracting position under the sheet stacking tray 401. The sheet stacking auxiliary tray 402 can be moved from the position illustrated in (a) of FIG. 9 to the position illustrated in (b) of FIG. 9 and be housed in the lower side of the sheet stacking tray 401. The sheet stacking auxiliary tray 402 is housed in this manner, and a sheet stacking box 420 illustrated in (a) to (c) of FIG. 10 that is attachable and detachable to and from the apparatus main body is placed. Subsequently, the conveying belt 407 sequentially conveys the sheet P to the sheet stacking box 420 as illustrated in (a) to (c) of FIG. 10, whereby the sheets P are accumulated in the sheet stacking box 420. With this configuration, if the sheet stacking box 420 is filled with the sheets P, for example, the sheet stacking box 420 can be replaced sequentially. Therefore, it is possible to limitlessly discharge the sheet P to the saddle-stitching stacking tray unit Z without stopping the operation of the apparatus for the convenience of the user who intends to output a large number of sheets P.

Figure 11:
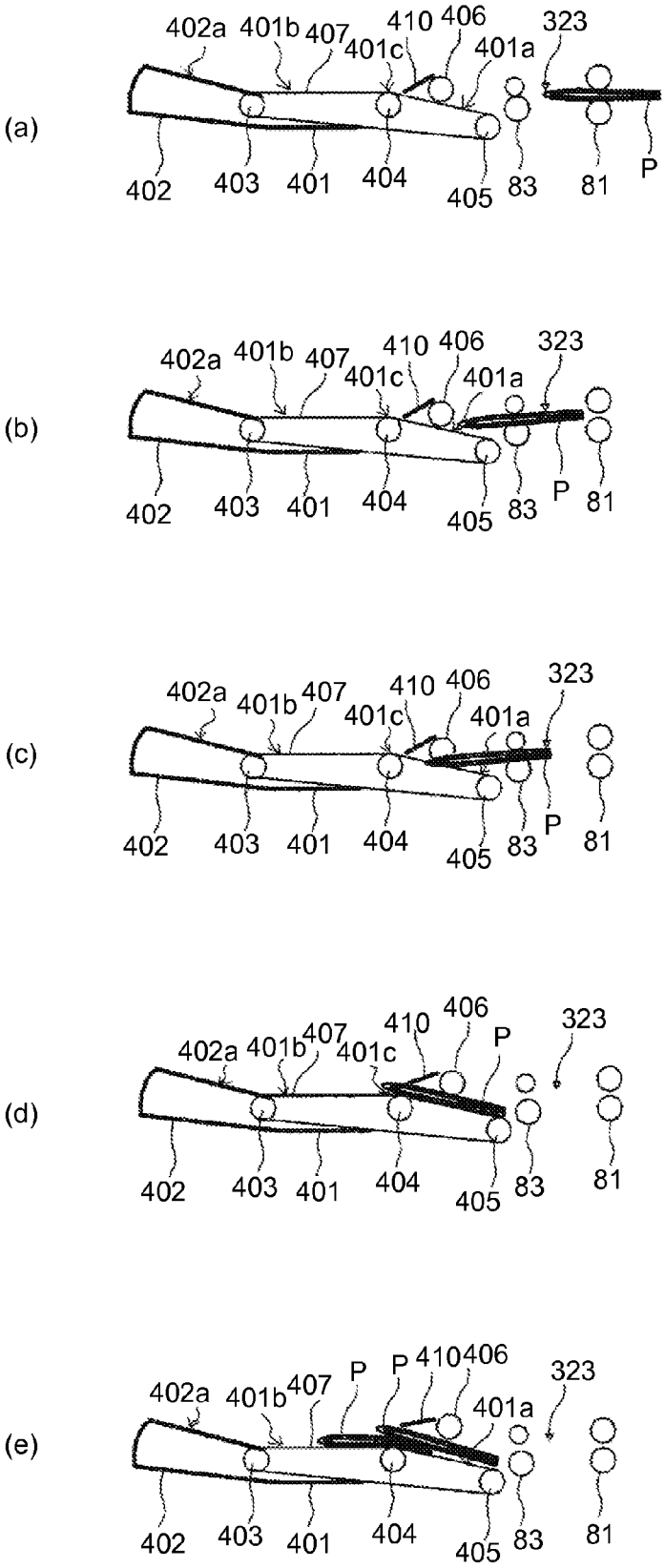
FIG. 11 is a schematic illustrating a state where sheets are stacked on the saddle-stitching stacking tray unit.

FIG. 11 is a schematic illustrating a state where the sheets P are stacked on the saddle-stitching stacking tray unit Z. The saddle-stitching stacking tray unit Z is controlled by a control unit, which is not illustrated, and the control unit is provided in the post-processing apparatus 200 or the image forming apparatus 300.

As illustrated in (a) of FIG. 11, the sheet P half-folded by the half-folding mechanism of the post-processing apparatus 200 is conveyed into the saddle-stitching stacking tray unit Z by the pair of folding rollers 81, for example. Typically in half-folding and saddle-stitching, additional folding to reduce the folded height, which is not illustrated, is performed after the processing. Therefore, after passing through the pair of folding rollers 81, the sheet P temporarily stops before reaching the pair of lower ejecting rollers 83.

If the half-folding is normally completed and discharging of the sheet P is performed, the system control shifts to half-folding and saddle-stitching stacking control. A fullness detecting feeler 410 provided swingably above the inclined surface of the sheet stacking tray 401 and in the vicinity of the downstream of the conveying driving roller 406 in the sheet conveying direction and a feeler position sensor, which is not illustrated, that detects the position of the fullness detecting feeler 410 detect and determine whether the saddle-stitching stacking tray unit Z is full. If it is determined that the saddle-stitching stacking tray unit Z is full, the feeler position sensor transmits a signal to the control unit. As a result, the control unit stops discharging the sheet P to the saddle-stitching stacking tray unit Z and the saddle-stitching stacking tray unit Z receives no sheet P.

If it is determined that the saddle-stitching stacking tray unit Z is not full and the saddle-stitching stacking tray unit Z can receive the sheet P, an instruction is transmitted to the driving source 412, thereby causing the conveying driving roller 406 and the conveying belt 407 to start to operate before the sheet P conveyed from the pair of lower ejecting rollers 83 reaches the conveying driving roller 406 as illustrated in (b) of FIG. 11.

At this time, the outer perimeter movement speed of the conveying driving roller 406 and the conveying belt 407 is lower than that of the pair of lower ejecting rollers 83 of the saddle-stitching stacking tray unit Z by nearly 0.3%. This configuration suppresses a pull given on the sheet P by the conveying driving roller 406 and the conveying belt 407 positioned on the downstream of the pair of lower ejecting rollers 83 in the sheet conveying direction. If the sheet P is pulled by the conveying driving roller 406 and the conveying belt 407, the sheet P slips at the pair of lower ejecting rollers 83. As a result, a skid mark is formed on the sheet P, thereby deteriorating the image quality. Furthermore, an extra load is placed on the conveying driving roller 406 and the conveying belt 407, resulting in unnecessary energy consumption.

Subsequently, the sheet P is conveyed by the conveying driving roller 406 and reaches the conveying driving roller 406 as illustrated in (c) of FIG. 11. After the sheet trailing end comes through the pair of lower ejecting rollers 83 as illustrated in (d) of FIG. 11, an instruction is transmitted to the driving source 412, thereby causing the conveying driving roller 406 and the conveying belt 407 to stop operating.

In FIG. 11, (e) is a schematic illustrating the following state: a subsequent sheet P is discharged such that the leading end of the subsequent sheet P, which is the second sheet, overlaps with the trailing end of a prior sheet P, which is the first sheet, discharged onto the sheet stacking tray 401 of the saddle-stitching stacking tray unit Z; the conveying driving roller 406 and the conveying belt 407 convey the sheets P until a part of the prior sheet P reaches the nearly horizontal surface 401*b* of the sheet stacking tray 401; and the sheets P are stopped. By forming an overlapping area between the prior sheet P and the subsequent sheet P in this manner, it is possible to prevent a folded part serving as the leading end of the subsequent sheet P from entering into an opening serving as the trailing end of the prior sheet P.

Thereafter, the sheet is sequentially conveyed to the saddle-stitching stacking tray unit Z repeatedly in the same manner as described above.

Figure 12:
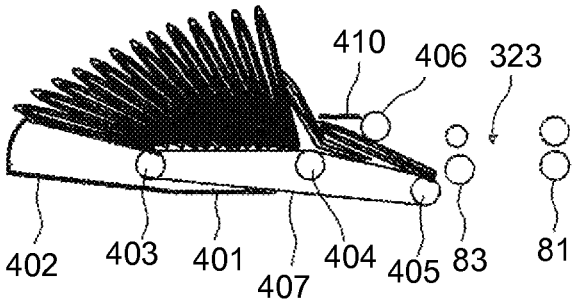
FIG. 12 is a view illustrating a sheet stacking state when the saddle-stitching stacking tray unit is full.

FIG. 12 illustrates a sheet stacking state when the sheet is repeatedly conveyed to the saddle-stitching stacking tray unit Z and the saddle-stitching stacking tray unit is full. If the sheet P reaches the sheet stacking auxiliary tray 402, the sheet stacking auxiliary tray 402 prevents the sheet P from falling and restricts the position of a leading sheet P (the first sheet P). Therefore, no sheet P is conveyed beyond the sheet stacking auxiliary tray 402. As subsequent sheets P are sequentially conveyed to the saddle-stitching stacking tray unit Z, the subsequent sheets P are stacked on the leading sheet P (the first sheet P) on the sheet stacking auxiliary tray 402. The sheet P thus half-folded and saddle-stitched has swelling at the folded part serving as the sheet leading end. Therefore, as the sheets P are stacked on the saddle-stitching stacking tray unit Z, the sheet P positioned on the downstream side of the saddle-stitching stacking tray unit Z in the sheet conveying direction rises. As a result, the sheets P are stacked to the position at which the fullness detecting feeler 410 and the feeler position sensor, which is not illustrated, detect the fullness.

If the series of jobs is completed, the half-folding and saddle-stitching control is terminated. If it is detected that the saddle-stitching stacking tray unit Z is full, the system control shifts to fullness control.

In the present embodiment, the sheet P discharged to the inclined surface 401*a* of the sheet stacking tray 401 by the pair of lower ejecting rollers 83 is conveyed from the inclined surface 401*a* to the nearly horizontal surface 401*b* by the conveying belt 407. Thus, the sheets P can be stacked on the nearly horizontal surface 401*b* of the sheet stacking tray 401. The inclined surface 401*a* is provided such that the end of the sheet stacking tray 401 on the downstream side in the sheet conveying direction is located higher than the end on the upstream side. As a result, it is possible to arrange the sheet stacking tray 401 at a level facilitating removal of the sheets P stacked on the nearly horizontal surface 401*b* and the like. Furthermore, compared with the case where the sheets are stacked on the inclined surface 401*a* that is significantly inclined, the sheets stacked on the nearly horizontal surface 401*b* are unlikely to collapse, thereby suppressing poor stacking. Because the sheets P stacked on the inclined surface 401*a* of the sheet stacking tray 401 can be sandwiched and held by the conveying driving roller 406 and the inclined surface 401*a*, collapse of the sheets P stacked on the inclined surface 401*a* of the sheet stacking tray 401 can be suppressed. Therefore, it is possible to arrange the sheet stacking tray 401 at a level facilitating removal of the sheets P and suppress poor stacking of the sheets P.

The embodiment described above is given just as an example, and the present invention has specific advantageous effects for the following aspects.

Aspect A

A sheet handling apparatus, such as the post-processing apparatus 200, includes a sheet folding unit, such as the folding plate 74 and the pair of folding rollers 81, that performs folding on a sheet, a sheet stacking unit, such as the sheet stacking tray 401, that stacks and houses the sheet on which the folding is performed by the sheet folding unit on a sheet stacking surface, and a discharging unit, such as the pair of lower ejecting rollers 83, that discharges the sheet on which the folding is performed by the sheet folding unit to the sheet stacking unit. The sheet stacking surface includes an inclined surface, such as the inclined surface 401*a*, inclined with respect to the horizontal plane such that an end on the downstream side in a sheet conveying direction is located higher than an end on the upstream side and a nearly horizontal surface, such as the nearly horizontal surface 401*b*, in order from the upstream to the downstream in the sheet conveying direction. The sheet stacking unit includes a sheet conveying unit, such as the conveying belt 407, that conveys the sheet discharged onto the inclined surface by the discharging unit from the inclined surface to the nearly horizontal surface and a conveying force applying unit, such as the conveying driving roller 406, that is provided above the inclined surface and comes into contact with the upper surface of the sheet to apply a conveying force to the sheet.

According to aspect A, sheets discharged onto an inclined surface of a sheet stacking surface by a discharging unit can be conveyed from the inclined surface to a nearly horizontal surface by a sheet conveying unit and be stacked on the nearly horizontal surface. As a result, the sheets stacked on the nearly horizontal surface are unlikely to collapse compared with the case where the sheets are stacked on the inclined surface, whereby it is possible to suppress poor stacking of the sheets. Furthermore, the sheets stacked on the inclined surface can be sandwiched and held by a conveying force applying unit and the inclined surface. Therefore, it is possible to suppress collapse of the sheets stacked on the inclined surface. Moreover, an end of the sheet stacking surface on the downstream side in a sheet conveying direction is located higher than an end on the upstream side. Therefore, compared with the case where the end of the sheet stacking surface on the downstream side in the sheet conveying direction and the end on the upstream side are located nearly at the same level, the user can remove the sheets stacked on the sheet stacking surface without bending down considerably. With this configuration, as described in the embodiment, it is possible to arrange the sheet stacking surface at a level facilitating removal of the sheet and suppress poor stacking.

Aspect B

In aspect A, an end of the inclined surface on the upstream side in the sheet conveying direction is positioned lower than a sheet discharging port of the discharging unit. With this configuration, as described in the embodiment, the sheet is sequentially conveyed such that a subsequent sheet overlaps with a prior sheet, whereby it is possible to suppress entering of a folded part, which is the leading end of the subsequent sheet, into an opening, which is the trailing end of the prior sheet.

Aspect C

In aspect A or aspect B, the sheet conveying unit and the conveying force applying unit are driven by the same driving source. By sharing the driving source that drives the sheet conveying unit and the conveying force applying unit therebetween in this manner, it is possible to reduce cost compared with the case where driving sources are separately provided.

Aspect D

In any one of aspect A to aspect C, a sheet stacking auxiliary unit, such as the sheet stacking auxiliary tray 402, that assists stacking of the sheet is provided on the downstream of the sheet stacking surface of the sheet stacking unit in the sheet conveying direction and is capable of being housed in a lower side of the sheet stacking surface. With this configuration, as described in the embodiment, it is possible to prevent the sheet from falling and restrict the position of the sheet. Furthermore, limitless discharging can be achieved for a user who intends to output a large number of sheets.

Aspect E

In any one of aspect A to aspect D, the sheet handling apparatus further includes a biasing unit, such as the biasing member 409, that presses the conveying force applying unit against the inclined surface. With this configuration, as described in the embodiment, it is possible to apply a conveying force strong enough for the sheet to ascend the inclined surface.

Aspect F

In any one of aspect A to aspect E, the speed of conveyance of the sheet performed by the sheet conveying unit and the conveying force applying unit is lower than the speed of conveyance of the sheet performed by the discharging unit. With this configuration, it is possible to suppress a pull given on the sheet by the sheet conveying unit and the conveying force applying unit.

Aspect G

In any one of aspect A to aspect F, the discharging unit includes a pair of ejecting rollers, and sequential conveyance performed by the sheet conveying unit and the conveying force applying unit is stopped at a timing after a prior sheet passes through the pair of ejecting rollers and is discharged onto the sheet stacking surface, a subsequent sheet is discharged onto the sheet stacking surface by the pair of ejecting rollers, and when the subsequent sheet reaches a position to ensure an overlapping area in which the prior sheet and the subsequent sheet overlap with each other. With this configuration, as described in the embodiment, it is possible to prevent a folded part, which is the leading end of the subsequent sheet, from entering into an opening, which is the trailing end of the prior sheet.

Aspect H

An image forming system includes an image forming unit that forms an image on a sheet and the sheet handling apparatus in any one of aspect A to aspect G. With this configuration, as described in the embodiment, it is possible to arrange the sheet stacking surface at a level facilitating removal of the sheet and suppress poor stacking.

According to the embodiment, it is possible to arrange a sheet stacking surface at a level facilitating removal of sheets and suppress poor stacking of the sheets.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet handling apparatus, comprising:

a sheet folding unit configured to perform folding on a sheet;

a sheet stacking unit configured to stack the sheet on which the folding is performed by the sheet folding unit on a sheet stacking surface, the sheet stacking surface having an inclined surface and a horizontal surface in order from upstream to downstream in a sheet conveying direction, the inclined surface being inclined with respect to a horizontal plane such that an end of the inclined surface on a downstream side in the sheet conveying direction is located higher than an end of the inclined surface on an upstream side;

a discharging unit configured to discharge the sheet on which the folding is performed by the sheet folding unit to the sheet stacking unit;

a sheet conveying unit configured to convey the sheet discharged onto the inclined surface by the discharging unit from the inclined surface to the horizontal surface;

a conveying force applying unit configured to apply a conveying force to the sheet in contact with an upper surface of the sheet, the conveying force applying unit being provided above the inclined surface; and a sheet stacking auxiliary unit configured to assist stacking of the sheet is provided on the downstream of the sheet stacking surface of the sheet stacking unit in the sheet conveying direction, the sheet stacking auxiliary unit being retractable under the sheet stacking surface.

2. The sheet handling apparatus according to claim 1, wherein an end of the inclined surface on the upstream side in the sheet conveying direction is positioned lower than a sheet discharging port of the discharging unit.

3. The sheet handling apparatus according to claim 1, wherein the sheet conveying unit and the conveying force applying unit are driven by a shared driving source.

4. The sheet handling apparatus according to claim 1, further comprising a biasing unit configured to press the conveying force applying unit against the inclined surface.

5. The sheet handling apparatus according to claim 1, wherein a speed of conveying the sheet performed by the sheet conveying unit and the conveying force applying unit is lower than a speed of conveying the sheet performed by the discharging unit.

6. The sheet handling apparatus according to claim 1, wherein the discharging unit includes a pair of ejecting rollers, and sequential conveyance performed by the sheet conveying unit and the conveying force applying unit is stopped at a timing after a sheet passes through the pair of ejecting rollers and is discharged onto the sheet stacking surface and when a subsequent sheet is then discharged onto the sheet stacking surface by the pair of ejecting rollers and thus the subsequent sheet reaches a position to ensure an overlapping area in which the prior sheet and the subsequent sheet overlap with each other.

7. An image forming system comprising:

an image forming apparatus configured to form an image on a sheet; and the sheet handling apparatus according to claim 1 to perform predetermined processing on the sheet.

8. The sheet handling apparatus according to claim 1, wherein the belt includes a curved surface between the inclined surface and the horizontal surface.

9. The sheet handling apparatus according to claim 1, further comprising a roller to support an inside of the belt, wherein the curved surface has a shape conforming to an outline of the roller.

10. The sheet handling apparatus according to claim 1, further comprising another inclined surface, the another inclined surface being provided on the downstream of the horizontal surface, and the another incline surface being inclined at an angle higher than that of the horizontal surface with respect to the horizontal plane.

* * * * *